US007406833B2

(12) United States Patent
Ertz et al.

(10) Patent No.: US 7,406,833 B2
(45) Date of Patent: Aug. 5, 2008

(54) REFRIGERATOR STORAGE SYSTEM

(75) Inventors: Lawrence J. Ertz, Amana, IA (US); Chad J. Rotter, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 401 days.

(21) Appl. No.: 11/141,274

(22) Filed: May 31, 2005

(65) Prior Publication Data

US 2006/0266070 A1 Nov. 30, 2006

Related U.S. Application Data

(63) Continuation-in-part of application No. 11/140,095, filed on May 27, 2005.

(51) Int. Cl.
*F25B 1/00* (2006.01)

(52) U.S. Cl. ..... 62/115; 62/382; 62/441

(58) Field of Classification Search ..... 62/441, 62/465, 440, 382; 312/291, 301, 334.1, 334.7, 312/334.27, 334.29, 334.34, 350, 404, 330.1, 312/334.8; 248/298.1
See application file for complete search history.

(56) References Cited

U.S. PATENT DOCUMENTS

| | | | | |
|---|---|---|---|---|
| 2,103,885 | A | 12/1937 | Whalen | |
| 3,295,908 | A | 1/1967 | Dawley | |
| 3,364,695 | A | 1/1968 | Saunders | |
| 4,597,616 | A | 7/1986 | Trubiano | |
| 4,788,832 | A | 12/1988 | Aoki | |
| 5,086,936 | A | 2/1992 | Remmers | |
| 5,303,997 | A | 4/1994 | Kropf | |
| 5,810,179 | A | 9/1998 | Kleiman | |
| 5,980,009 | A | 11/1999 | Atalla | |
| 6,050,097 | A | 4/2000 | Nelson et al. | |
| 6,351,967 | B1 | 3/2002 | Adachi et al. | |
| 6,491,173 | B1 | 12/2002 | Costa | |
| 6,565,170 | B2 | 5/2003 | Banicevic | |
| 6,578,720 | B1 | 6/2003 | Wang | |
| 6,735,959 | B1 * | 5/2004 | Najewicz | 62/3.63 |
| 6,810,682 | B1 | 11/2004 | Schuchart | |
| 6,964,177 | B2 | 11/2005 | Lee et al. | |
| 7,065,975 | B1 | 6/2006 | Herndon et al. | |
| 7,076,967 | B2 | 7/2006 | Lee et al. | |
| 2006/0090496 | A1 | 5/2006 | Adamski et al. | |

FOREIGN PATENT DOCUMENTS

| | | | |
|---|---|---|---|
| EP | 1 482 263 | A2 | 1/2004 |
| EP | 1 517 103 | A2 | 3/2005 |
| EP | 1 519 131 | A1 | 3/2005 |
| GB | 2 079 424 | A | 1/1982 |
| WO | WO 03/102481 | A1 | 12/2003 |
| WO | WO 2004/085937 | A1 | 10/2004 |

* cited by examiner

*Primary Examiner*—Mohammad M Ali
(74) *Attorney, Agent, or Firm*—Kirk Goodwin; Michael D. Lafrenz

(57) ABSTRACT

A refrigerator comprising a fresh food compartment, a freezer compartment, a lower freezer drawer and an upper freezer bin. A primary set of glides allow the freezer drawer and the upper bin to be pulled out of the freezer compartment. A secondary set of glides mounts the upper bin onto the lower drawer for movement along the drawer, and back into the freezer compartment to allow access to the contents of the lower drawer.

12 Claims, 10 Drawing Sheets

REFRIGERATOR STORAGE SYSTEM

CROSS-REFERENCE TO RELATED APPLICATIONS

This application is a Continuation-in-Part Application of U.S. application Ser. No. 11/140,095 filed May 27, 2005, which application is hereby incorporated by reference in its entirety.

BACKGROUND OF THE INVENTION

The current invention relates to a refrigerator storage system and method of use.

Refrigerator freezers which have a bottom freezer compartment and an upper fresh food compartment are becoming more popular. Some bottom freezers have a large drawer which pulls out of the freezer compartment to allow access to items stored in the freezer drawer. One problem with such a large, single drawer is food items get buried and stacked, which makes it difficult to get to some items stored within the freezer drawer.

Some freezer drawers have a slidable tray which slides laterally across the width of the drawer and perpendicular to the travel of the drawer, allowing access to items in one side or the other of the drawer. If a person needs to get to the items stored on the other side of the drawer, they simply slide the upper storage bin to the left or to the right to gain access to the other side.

Some refrigerator freezers have multiple drawers that pull out separately. With these, one must pull out the main drawer and then pull out a second or third drawer to gain access to items in the top drawer, such as ice.

One problem with the aforementioned style of freezer compartment is that a person does not have access to all of the storage space in the freezer and therefore has a difficult time retrieving items stored in the freezer. Therefore, it is desirable to have an improved refrigerator storage system and method of use.

The primary feature or advantage of the present invention is to provide an improved refrigerator storage system and method of use.

Another feature or advantage of the present invention is allowance of easy access to items stored in a refrigerator freezer pull out drawer.

A further feature or advantage of the current invention is a method of mounting a bottom storage system in a refrigerator allowing easy access to all portions of the storage system.

A further feature or advantage of the current invention is a provision of a refrigerator storage system which is economical to manufacture, durable in use, and efficient in operation.

These and other features or advantages of the invention will be apparent from the specification and claims that follow.

SUMMARY OF THE INVENTION

A refrigerator comprises a fresh food compartment with at least one door, and a freezer compartment below the fresh food compartment. The freezer compartment has a door and a bottom wall, opposite side walls, and a back wall. The freezer door is connected to the front wall of a freezer drawer mounted on a primary set of glides. The glides are connected to the side walls in the freezer compartment allowing the freezer drawer to be pulled forwardly out of the freezer compartment. A secondary set of glides is mounted to the side walls of the drawer and support a second bin or basket above the drawer for forward and rearward movement between the freezer door and the back wall of the freezer compartment.

Another feature or advantage may be achieved by a refrigerator storage system comprising a refrigerator freezer drawer, the drawer moveable in and out of the refrigerator freezer compartment with a primary set of glides. A secondary set of glides is operatively connected to the drawer and/or a drawer cradle allowing a bin or basket to move back and forth above the drawer and back into the freezer compartment when the drawer is pulled out of the freezer compartment.

A further feature or advantage of the present invention may be achieved by a method of mounting a bottom storage system in a refrigerator freezer comprising the steps of attaching a primary set of glides between a first freezer bin or basket, to the freezer compartment side walls to allow the first freezer bin or basket to move in and out of the freezer compartment; attaching a secondary set of glides to the first freezer bin or basket and to a second freezer bin or basket to allow a user to move the second freezer bin or basket forwardly and rearwardly above the first freezer bin or basket and into the freezer compartment while the first freezer bin or basket is pulled out of the freezer compartment.

DETAILED DESCRIPTION OF THE PREFERRED EMBODIMENT

This invention relates to a refrigerator storage system and method of use. The invention will be shown and described as a bottom mount refrigerator storage system and method of use. However, the invention can be used with any type of refrigeration system in any location within a refrigerator/freezer. Therefore, the invention is not to be limited to a bottom mount freezer refrigerator storage system.

Figure 1:
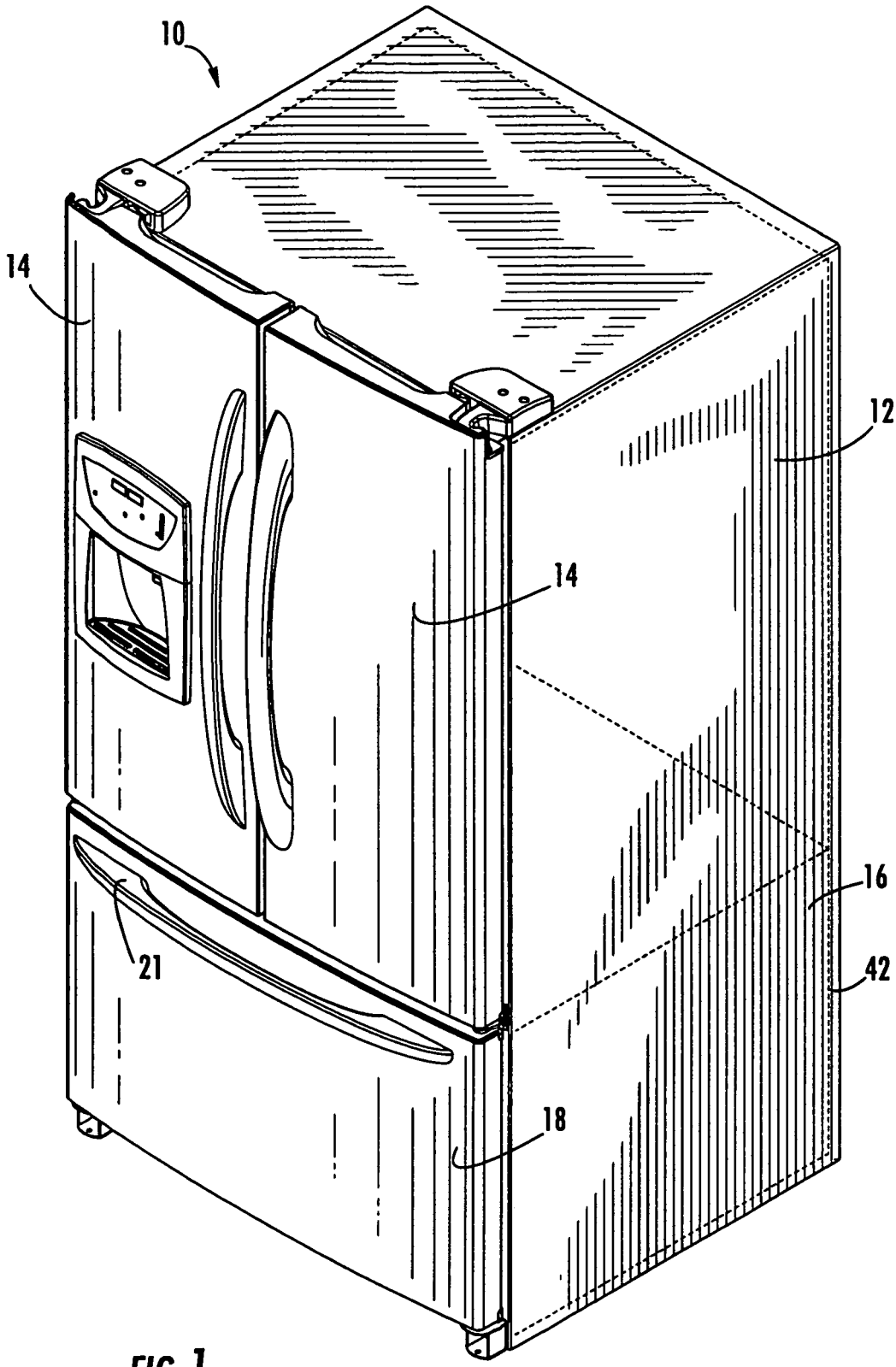
FIG. 1 is a perspective view of a bottom mount refrigerator having the storage system of the present invention.
Figure 2:
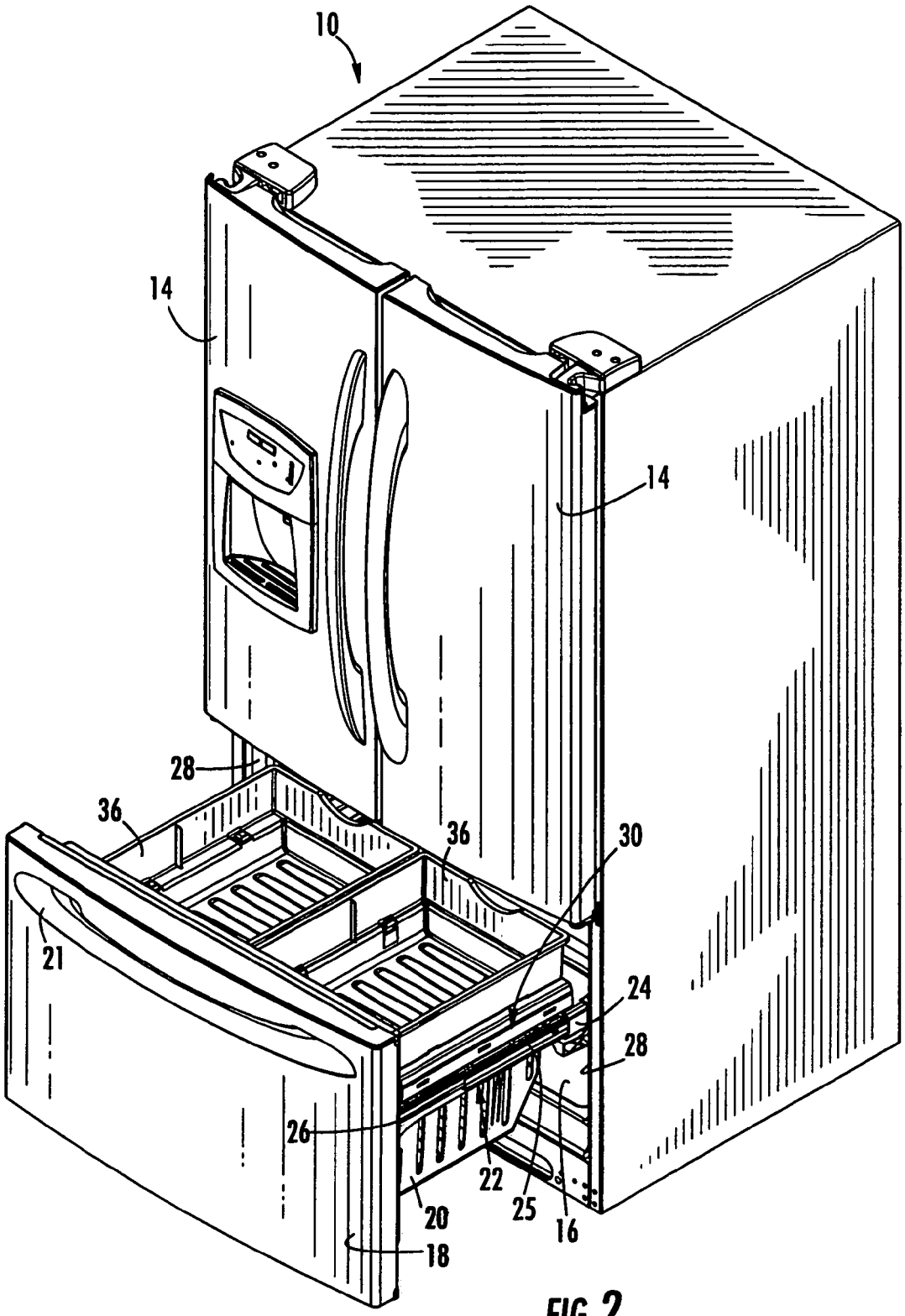
FIG. 2 is a perspective view of a bottom mount refrigerator with the freezer drawer pulled out.
Figure 3:
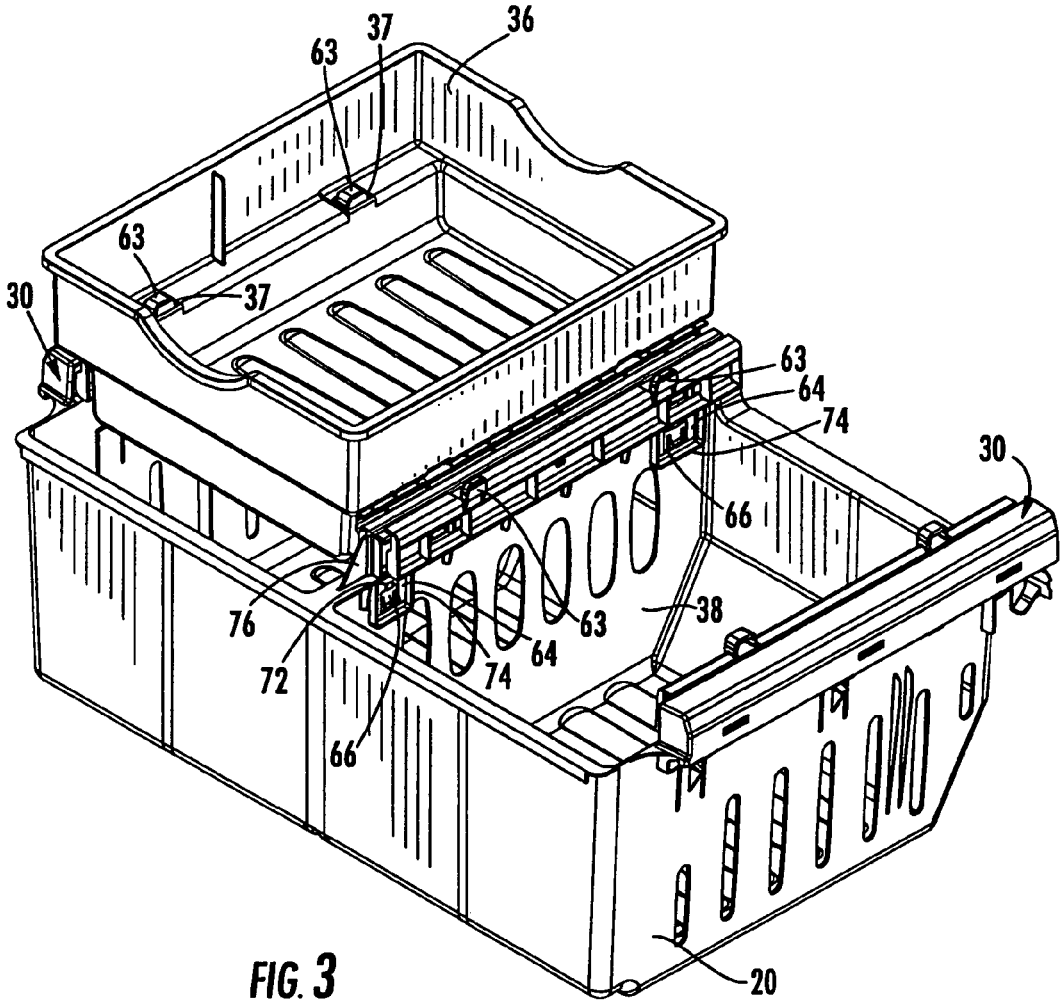
FIG. 3 is a perspective view showing the freezer drawer of the present invention removed from the refrigerator and with one upper bin removed for clarity.
Figure 4:
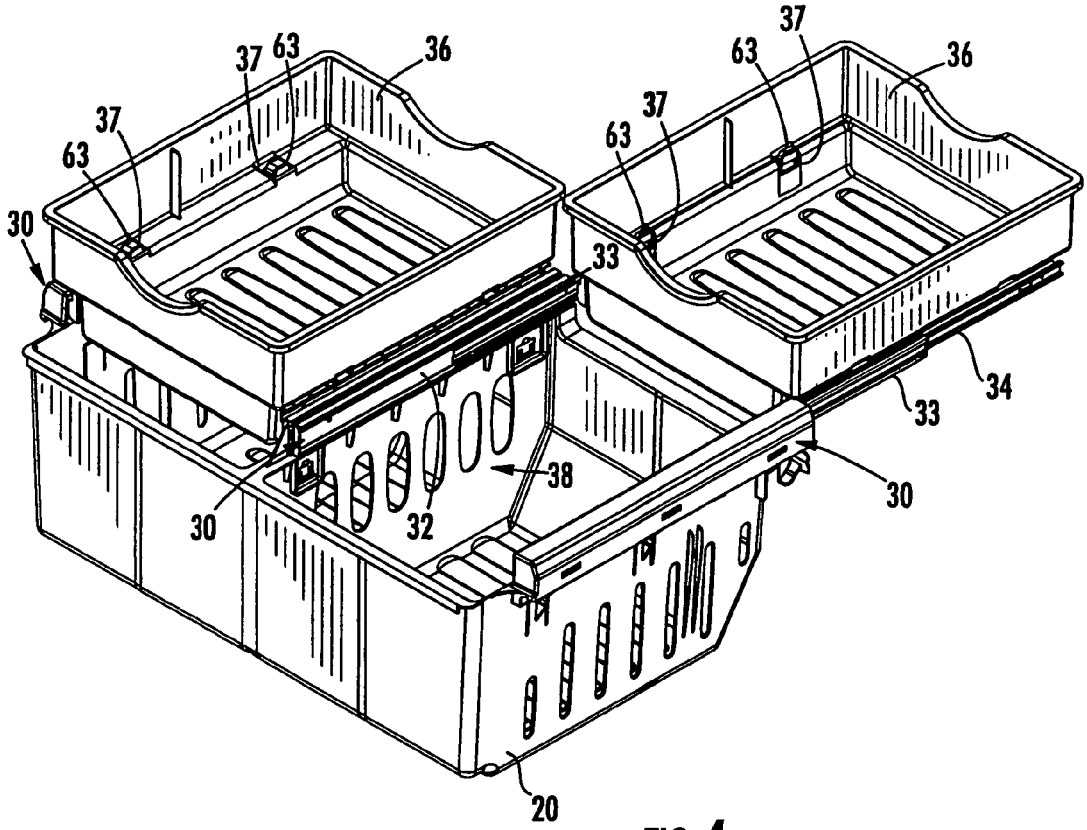
FIG. 4 is a view similar to FIG. 3 with the one bin moved forwardly and another bin moved rearwardly.
Figure 5:
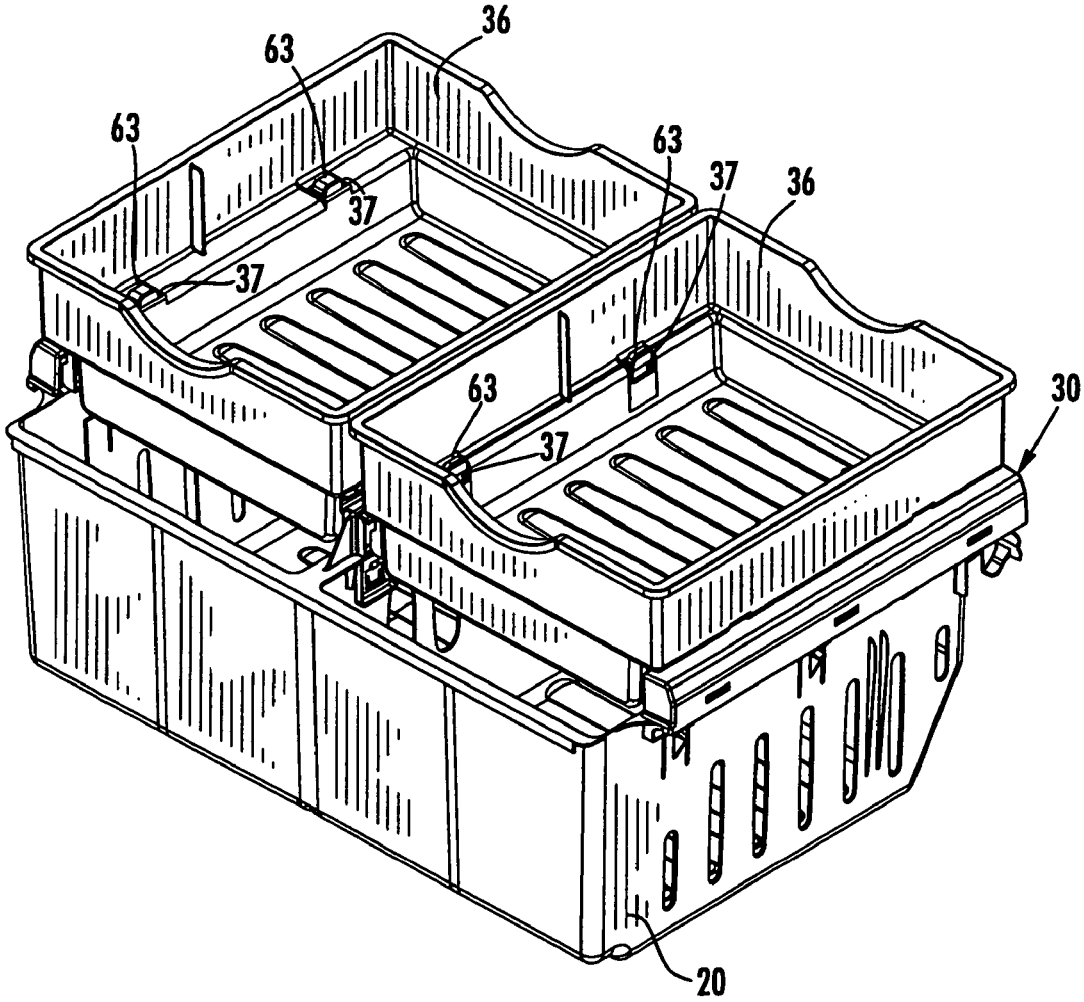
FIG. 5 is a view similar to FIG. 3 with both bins moved forwardly.
Figure 6:
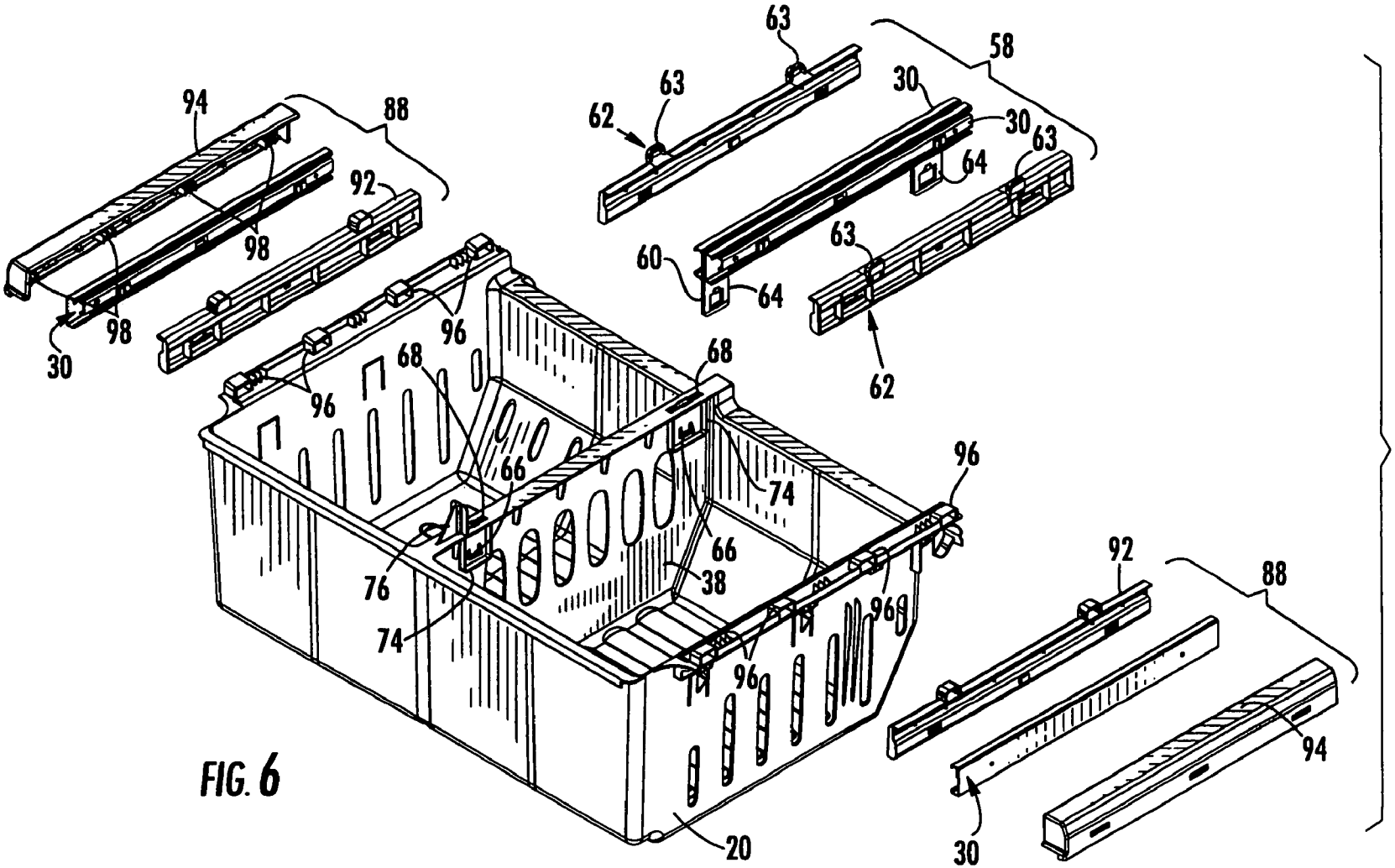
FIG. 6 is an exploded view of the lower drawer and secondary glide assemblies.
Figure 7:
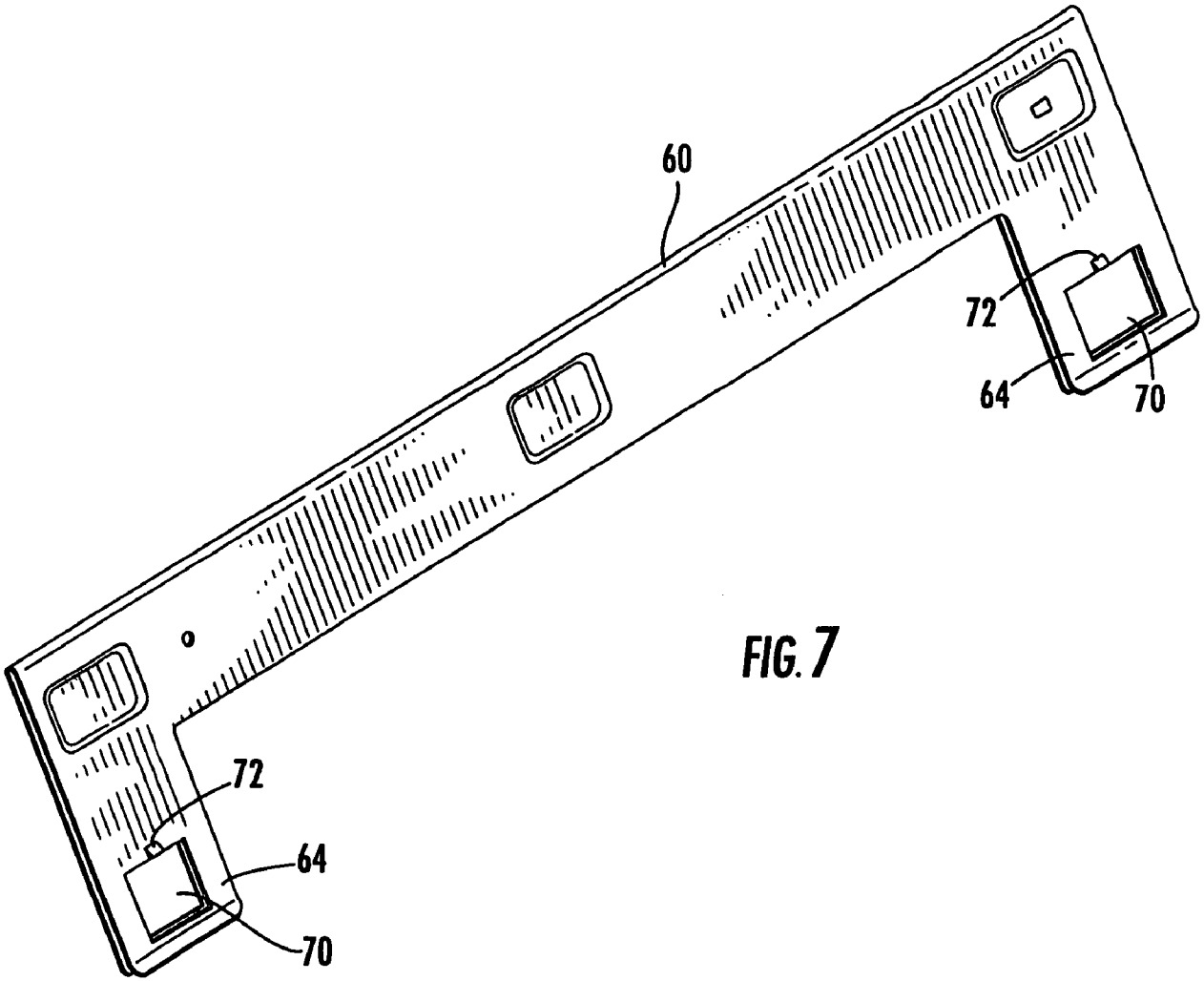
FIG. 7 is a perspective view of one embodiment of a center glide bracket.

Referring to FIGS. 1 and 2, the current invention is preferred to be used on a bottom mount refrigerator 10, but can be used on any type of appliance. Generally, a refrigerator 10 has a fresh food compartment 12 with one or more fresh food door(s) 14. Additionally, there is a freezer compartment 16 having a freezer door 18. The freezer door 18 operatively connects to the front wall of a lower freezer drawer 20. The lower freezer drawer 20 can be either a bin, a basket, or other similar type storage container. The freezer drawer 20 can be pulled out of the freezer compartment 16 using the handle 21 on the door 18. However, the freezer drawer 20 does not have to be completely removed from the freezer compartment 16 and may have a portion of the freezer drawer 20 remaining within the freezer compartment 16.

The freezer drawer 20 pulls out of the freezer compartment 16 by the use of main glides 22. The main glides 22 can be standard furniture drawer glides, custom made glides for this specific application or other types of glides. Each of the main glides 22 has a female track or channel member 24 and a male member 26 slidably or rollably received in the track 24. The glides 22 can have other members, such as the glide center member 25, and are preferred to be telescoping with rollers or ball bearings. In one embodiment, the tracks 24 are mounted to the inside walls 28 of the freezer compartment 16 and the male members 26 of the main glides 22 are mounted to the freezer drawer 20. However, the main glide 22 can be mounted in any way such that the freezer drawer 20 can slide or roll easily in and out of the freezer compartment 16. Stop elements (not shown) may be provided on the main glides 22 to prevent the drawer 20 from being pulled completely out of the refrigerator 10 or pushed too far into the freezer compartment.

The invention includes one or more sets of secondary glides 30. The secondary glides 30 can be similar construction as the main glides 22. The female tracks 32 of the secondary glides 30 are attached to the side walls of the freezer drawer 20. The male members 34 of the secondary glides 30 are attached, and preferably removeably attached, to an upper freezer, drawer, bin or basket 36 for movement forwardly and rearwardly above the freezer drawer 20. Similar to the main glides 22, the secondary glides 30 can have other members, such as the glide center member 33, and are preferred to be telescoping with rollers or bearings.

Since the upper freezer drawers or baskets 36 are supported by the lower freezer drawer 20, the upper freezer drawers 36 are pulled out of the freezer compartment 16 with the lower freezer drawer 20. Then, the upper freezer drawer 36 can be pushed back away from the freezer door 18 and back into the freezer compartment 16 in order to allow access to the lower freezer drawer 20. Stop elements (not shown) may be provided on the secondary glides 30 to limit travel of the upper drawer(s) 36. There can be any number of lower drawers 20 and upper drawers 36.

The lower freezer drawer 20 can be constructed with a lower drawer center wall 38. The lower drawer center wall 38 allows both structural support for the lower freezer drawer 20 and allows for multiple sets of secondary glides 30 to be mounted to the lower freezer drawer 20. The term secondary glides assemblies 30 means any secondary glides. The preferred embodiment, shown in the figures, shows a center glide assembly 58 and outer glide assemblies 88, which are secondary glide assemblies.

In one embodiment, the center glide assembly 58 comprises a bracket 60, 2 glides 30, 2 rivets (not shown) and 2 bin adapters 62. The glides 30 are fastened to the bracket 60 using the 2 rivets to attach female tracks 32 of the secondary glides 30 to bracket 60. The assembly 58 is attached to the lower drawer 20 by 4 snap tabs 64 on the bracket 60 and 4 snap lugs 66 on the lower drawer 20. The snap tabs 64, have formed lead-in edges, which are inserted into the slotted openings 68 in the lower drawer 20. As the snap tabs 64 travel downward along the center wall structure 38 of the lower bin 20 they deflect over the snap lugs 66. As the snap tabs 64 clear the snap lugs 66 they spring back to create a connection between the lower edge of the tab piercings 70 and the lug 66 undersides, thus insuring the undersides of the glides 30 are forcibly seated upon the flat surface of the lower bin center wall structure 38.

Removal of the assembly 58 is accomplished by the use of a tool and formed louvers 72 atop each of the 4 snap tab piercings 70. The louvers 72 are preferred as a means of disassembly as the formed lead-in edges of the snap tabs 64 are guarded by the "U" shaped walls 74 that surround the perimeters of installed snap tabs 64.

The presence of the gusseted wall 76 near the front wall of the lower bin 20 serves to prevent misassembly of the center glide assembly 58 and thus insuring proper orientation of glides 30 and direction of glide extension. This feature also serves to improve the appearance of the assembly. The absence of this feature would allow the user unobstructed visual access to the end view of the glide mechanism 30.

The center glide assembly 58 is finished by attaching the center bin adapters 62 to male members 34 of the glides 30. The bin adapters 62 serve the function of locating the upper bin(s) 36 to the glides 30 and transferring the load of the upper bins 36 to the glides 30. Were it not for a locating feature between the upper bin(s) 36 and the glides 30, glide extension would not be insured. Independent motion of the upper bin(s) 36 relative to the glides 30, bin adapters 62 may result in the falling of the upper bin(s) 36 into freezer compartment 16 behind the opened pullout drawer 20. Conversely, should the bin(s) 36 and glides 30/bin adapter(s) 62 have traveled successfully in unison rearward, the user may pull the upper bin(s) 36 forward while one or both glides 30 fail to travel forward. The locating method chosen involves a pair of lugs 63 per bin adapter 62, of which there are 2 per upper bin 36 which fit into a corresponding pair of openings 37 in the upper bin 36. This provides the user visual access to the operation of aligning the upper bin 36 to the bin adapters 62. To attach the bin adapters 62 to the glides 30, a pair of formed bayonets (not shown) exist in the male members 34 of the glides 30. These bayonets in conjunction with corresponding openings in the bin adapters 62 capture and compress the bin adapter 62 against the face of the glide male members 34, therefore creating a connection. The bin adapter 62 is pulled forward during assembly against the glide's closed position, in the direction of the door 18 of the pullout drawer 20. The bin adapter 62 is keyed to the glide male member 34 when fully installed, preventing disassembly.

The outer glide assemblies 88 and the outer bin adapters 92 serve the same functions and are connected similarly as described above. The attachment of the glides 30 to the lower bin 20 is accomplished through the use of glide retainers 94, glide profile and the lower bin 20. The lower bin 20 has a plurality of tapered box sections 96 which receive correspondingly tapered lugs 98 of the glide retainers 94. The glide retainer lugs 98 are inserted into the box sections 96 of the lower bin 20 and due to their taper initially fit loosely. A tight fit is achieved when the lug 98 is fully inserted into the box section 96. At approximately this time, three snaps on the glide retainer 94 will engage features in the lower bin 20, maintaining the location and therefore the tight connection. The combination of the glide retainer 94 and the lower bin 20 form a receiving, approximate female version of the glide 30 outside profile. To assemble the glide 30 into the receiving assembly, comprised of glide retainer 94, lower bin 20 and glide profile, the upper outside surface of the glide 30 may be tucked under the lip of the glide retainer 94. In this state of assembly, the lower outside surface of the glide 30 is in approximate contact with a tapered lip of the lower bin and upon applying a force, the glide 30 will travel along the tapered lip of the lower bin 20 and snap into place behind the lip.

Figure 8:
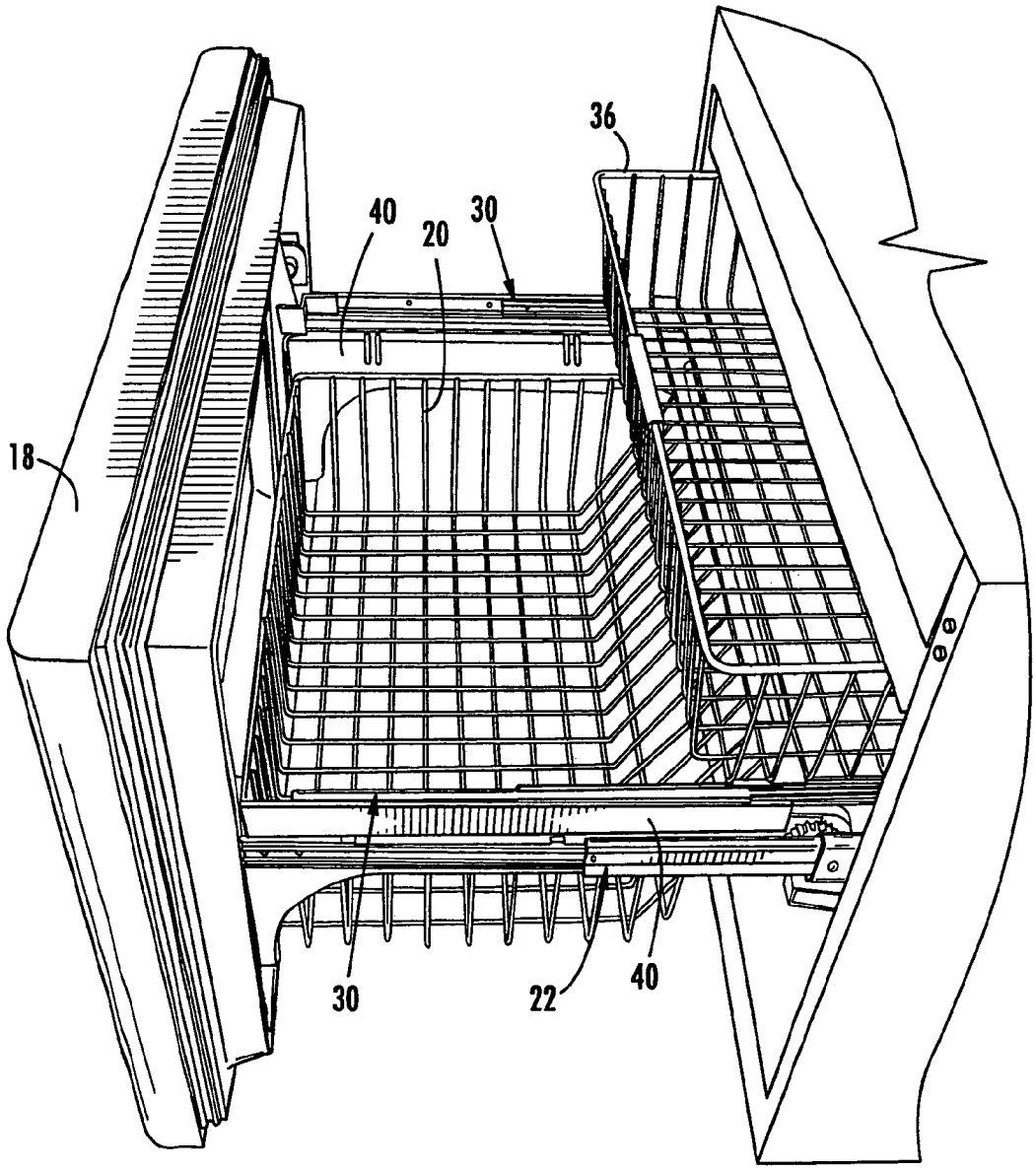
FIG. 8 is a perspective view of an alternative embodiment of the invention wherein the freezer drawer and upper bin are baskets.
Figure 9:
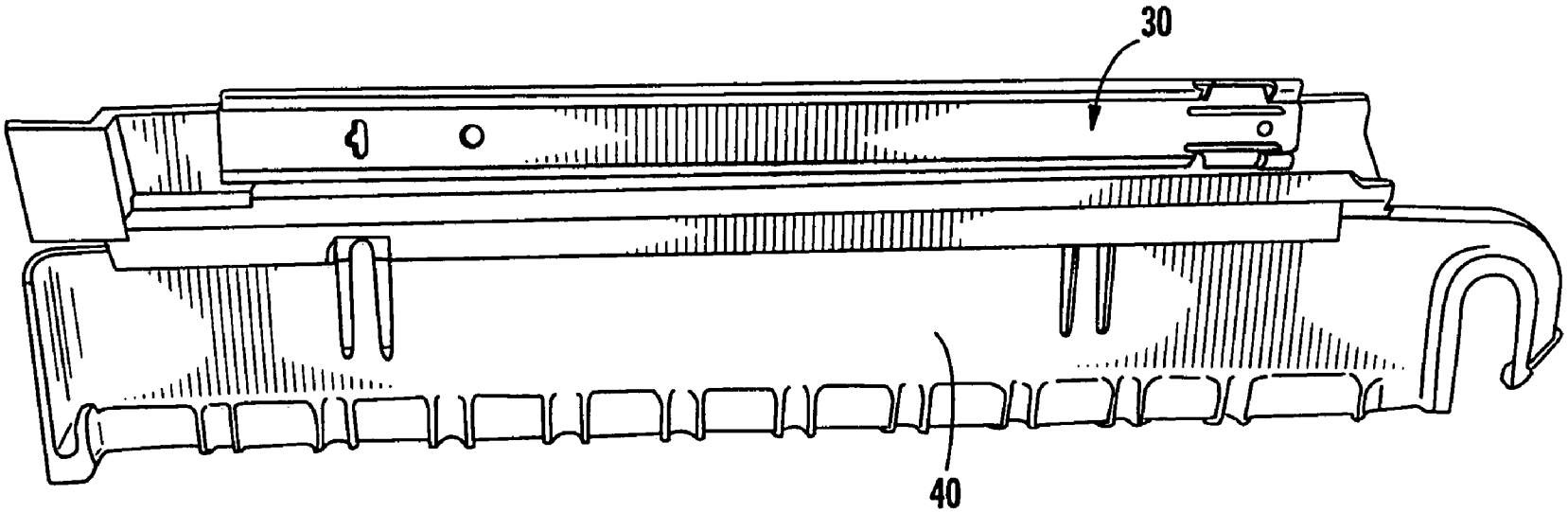
FIG. 9 is a side elevation view of a cradle for the drawer with a secondary glide attached.
Figure 10:
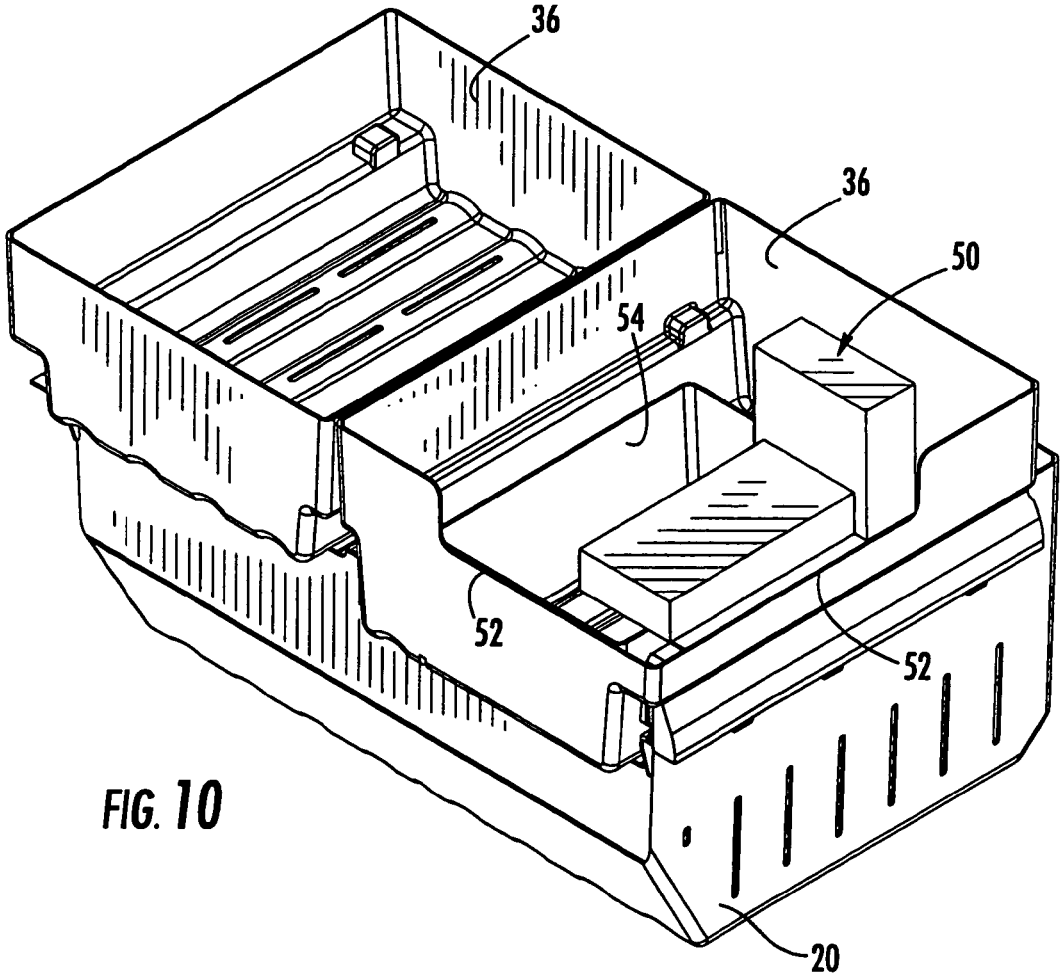
FIG. 10 is a perspective view similar to FIG. 3 viewed from the back side showing an upper bin with one embodiment of an upper bin configured to use with an ice maker.

The freezer drawers 20, 36 can be constructed from plastic, metal, a wire mesh basket, or other similar type construction. To aid in structural support of a mesh lower freezer drawer 20, as seen in FIG. 8, lower basket cradles 40 can be used to support the lower freezer drawer 20 and used for mounting both the main glides 22 and/or the secondary glides 30. The lower basket cradle 40 is basically is a rigid member adding structural support to the lower freezer drawer 20.

The refrigerator 10 can be equipped with an icemaker assembly 50 in the freezer compartment 16, which can release ice cubes into one of the upper freezer drawers 36. The icemaker assembly 50 is preferred to be attached inside the freezer compartment 16, but is shown floating above an upper bin for ease of viewing. Thus, as the lower freezer drawer 20 is pulled out of the freezer compartment 16, the upper freezer drawer 36 will present ice for the user in an ice bin 54. Thus, the user would not have to pull out the lower freezer drawer 20 and then pull out the upper freezer drawer 36 to gain access to ice. When the freezer compartment 16 is opened and the upper freezer drawer 36 is pulled away from the icemaker 50, the icemaker 50 is preferred to be shut off so that ice is not discharged behind the upper freezer drawer 36. Icemaker cutouts 52 can be used on an upper bin 36 and ice bin 54 to allow the upper bin 36 and ice bin 54 to move back and forth under the icemaker 50. The ice bin 54 is preferred to be removable from the upper bin 36.

The upper freezer drawer 36 is preferred to be removable from the lower freezer drawer 20. In addition, the upper freezer drawer 36 does not have to be pulled forwardly over the lower freezer drawer 20 in order to close the lower freezer drawer 20. In other words, when a person pulls out the lower freezer drawer 20 and pushes back the upper freezer drawer 36 into the freezer compartment 16, the upper freezer drawer 36 will automatically be pushed back into position above the lower freezer drawer 20 by the freezer back wall 42, a glide stop device, or other device stopping rearward movement of the upper bin 36 when the freezer door 18 is pushed rearward to close the freezer compartment 16.

As mentioned above, the main glides 22 and the secondary glides 30 are preferred to be telescoping glides with rollers. However, other types of glides can be used. It is also preferred that the glides be constructed with sufficient rigidity so that when upper freezer drawers 36 are pushed back into the freezer compartment 16, the upper freezer drawer 36 remains relatively level and does not tilt downward to drop the contents of the upper freezer drawer 36.

The drawers 20, 36 of this invention are preferred to be made so that they can be assembled and installed into the freezer compartment 16 quickly and easily. In addition, it is preferred that drawers be made so that they can be interchangeable with respect to the locations of their use in the refrigerator 10.

In summation, the current invention is preferred to be the positioning and attachment of glide rails 22, 30 that support multiple storage bins and/or basket configurations 20, 36, inside the freezer compartment 16 of a refrigerator 10. The design preferably consists of main support glides 22 onto which the freezer door 18 and the lower freezer drawer 20 is attached and has a set or sets of secondary glides 30 mounted in an opposite travel direction on either the lower drawer 20 itself or lower basket cradles 40 for the purpose of supporting an upper freezer drawer or drawers 36. The design allows the upper drawer or drawers 36 to be pulled forward or out of the freezer compartment 16 with the lower drawer 20 when opening the freezer door 18 and further allows for the upper drawer 36 to be pushed back inside the freezer compartment 16 for easy access to the contents of the lower drawer 20. The secondary glides 30 also allow the freezer door 18 and lower basket 20 to be returned to the closed position without first returning the upper drawer 36 to its original position.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator comprising:

a fresh food compartment;

a freezer compartment below the fresh food compartment;

the freezer compartment having a bottom wall, side walls, a back wall;

a lower freezer drawer including side walls having a top edge;

a primary set of glides connected to the side walls of the freezer compartment and to the freezer drawer to allow the freezer drawer to be pulled forwardly out of the freezer compartment and to be pushed rearwardly into the freezer compartment;

at least one upper freezer bin; and a secondary set of outer glides assemblies mounting the upper freezer bin on the lower freezer drawer and allowing the upper bin to be moved forwardly and rearwardly relative to the lower drawer;

wherein each outer glide assembly includes an outer glide having at least a female track and a male member, a bin adaptor attached to the male member and having a support surface to support an upper freezer bin, and a glide retainer connecting the female track to the lower freezer drawer; and further wherein the at least one upper freezer bin engages two bin adaptor support surfaces to mount the at least one upper freezer bin on the lower freezer drawer.

2. The refrigerator of claim 1 wherein the lower freezer drawer includes at least one intermediate wall and further comprising multiple upper freezer bins mounted to and, located above the lower drawer and at least one secondary intermediate glide assembly comprising;

a bracket arranged to snap onto an intermediate wall;

at least one intermediate glide having at least a female track and a male member and having the female track attached to the bracket; and a bin adaptor attached to the male member and having a support surface to support an upper freezer bin;

wherein at least one upper freezer bin engages an outer glide assembly bin adaptor support surface and a secondary intermediate glide assembly bin adaptor support surface to mount the at least one upper freezer bin to the lower freezer drawer.

3. The refrigerator of claim 1 wherein primary set of glides and/or the secondary set of glides include rollers.

4. The refrigerator according to claim 1, wherein the bin adaptors include a pair of lugs projecting from the bin adaptor support surface to engage an upper freezer bin, and wherein the upper freezer bin includes pairs of openings on opposite sides of the upper freezer bin arranged to receive the lugs of the bin adaptors supporting opposite sides of the upper freezer bin.

5. The refrigerator according claim 2, wherein the bracket includes snap tabs, the at least one intermediate wall includes slotted openings, and wherein the slotted openings are arranged to receive the bracket snap tabs to snap the bracket onto the at least one intermediate wall.

6. The refrigerator according to claim 5, wherein the at least one intermediate wall includes snap lugs associated with each slotted opening and the snap tabs include piercings arranged to engage a snap lug to connect the bracket to the at least one intermediate wall.

7. The refrigerator according to claim 6, wherein the at least one intermediate wall includes two slotted openings each having two snap lugs and further wherein the bracket includes two pairs of snap tabs arranged to engage the slotted openings in the intermediate wall.

8. The refrigerator according to claim 2, wherein the at least one intermediate wall is in the center of the lower freezer drawer, two intermediate glides are attached to the bracket and two upper freezer bins are mounted over the lower freezer drawer with each upper freezer bin engaging an outer glide assembly bin adaptor support surface and an intermediate glide assembly bin adaptor support surface.

9. The refrigerator according to claim 1, wherein the lower freezer bin includes a plurality of tapered box sections along the top edge of the side walls, and wherein the glide retainers include a plurality of tapered lugs arranged to engage the plurality of tapered box sections to connect the female track of a glide to the lower freezer drawer.

10. The refrigerator according to claim 9, wherein the glide retainers further include a plurality of snaps and the lower freezer bin further includes a plurality of surfaces to engage the plurality of snaps to maintain the glide retainer and glide in position on the lower freezer drawer.

11. A method of mounting a bottom storage system in a refrigerator freezer comprising the steps of:

attaching a primary set of glides to a freezer drawer and to freezer side walls to support the drawer for movement into and out of the freezer;

attaching a secondary set of outer glide assemblies to the freezer drawer to support an upper bin above the freezer drawer for forward or rearward movement on the freezer drawer including the steps, of snapping a bin adaptor to each outer glide; positioning each outer glide in a glide retainer and snapping each glide retainer and outer glide to the freezer drawer to retain the outer glides on the freezer drawer; and mounting the upper bin on the bin adaptors.

12. The method of mounting a bottom storage system in a refrigerator freezer according to claim 11, wherein the freezer basket includes a center wall and two upper bins are supported above the freezer drawer for forward and rearward movement on the freezer drawer; the steps further including attaching two intermediate glides to a bracket; attaching two bin adaptors to the intermediate glides to form a center glide assembly; attaching the center glide assembly to the freezer drawer by snapping the bracket onto the center wall; and mounting the upper bins to the freezer basket with each upper bin engaging an outer glide assembly bin adaptor and a center glide assembly bin adaptor.

* * * * *